United States Patent [19]

Foscarini et al.

[11] 4,323,140

[45] Apr. 6, 1982

[54] SAFETY LANDING

[76] Inventors: Anthony Foscarini; John Foscarini; Corrado Comello, all of 17 Malley Rd., Scarborough, Ontario, Canada, M1L 2E4

[21] Appl. No.: 170,115

[22] Filed: Jul. 18, 1980

[30] Foreign Application Priority Data

May 9, 1980 [CA] Canada ..... 351629

[51] Int. Cl.[3] ..... E04G 3/14; E04G 1/36

[52] U.S. Cl. ..... 182/128; 182/82; 182/222

[58] Field of Search ..... 182/128, 82, 84, 222, 182/223, 91, 92

[56] References Cited

U.S. PATENT DOCUMENTS

| | | | |
|---|---|---|---|
| 521,820 | 6/1894 | Rowell | 182/128 |
| 789,174 | 5/1905 | Seeley | 182/128 |
| 2,908,361 | 10/1959 | Reighart | 182/128 |
| 3,038,555 | 6/1962 | Da Lee | 182/128 |
| 3,044,572 | 7/1962 | Thomas | 182/128 |
| 3,166,154 | 1/1965 | Titzel | 182/128 |
| 3,289,788 | 12/1966 | Evans | 182/128 |
| 4,029,355 | 6/1977 | Wilhelmsen | 182/91 |
| 4,159,122 | 6/1979 | Stevens | 182/91 |

FOREIGN PATENT DOCUMENTS

| | | | |
|---|---|---|---|
| 520747 | 5/1940 | United Kingdom | 182/128 |

*Primary Examiner*—Reinaldo P. Machado
*Attorney, Agent, or Firm*—George H. Riches

[57] ABSTRACT

A novel safety platform for use in a vertical shaft such as a manhole. The platform comprises a pair of support beams with the ends of each support beam mounted in the wall of the shaft. At least one panel extends across the shaft and bridges the support beams with a novel wedge clip at one end of the panel to allow the panel to be opened or secured in the closed position. A novel pivotting means is provided at the other end of the panel which pivotally secures the panel to the opposite support beam. The platform may be installed easily with fewer problems than the prior art yet provides increased safety factors for the user.

13 Claims, 11 Drawing Figures

FIG.1.
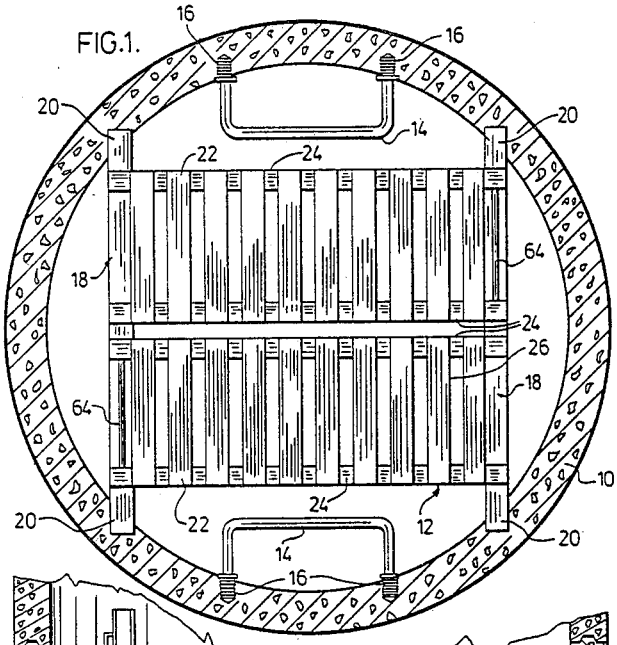
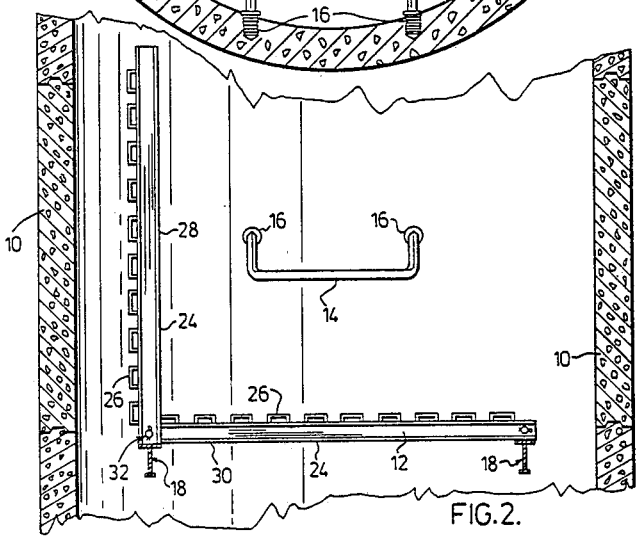
FIG.2.

FIG.3.
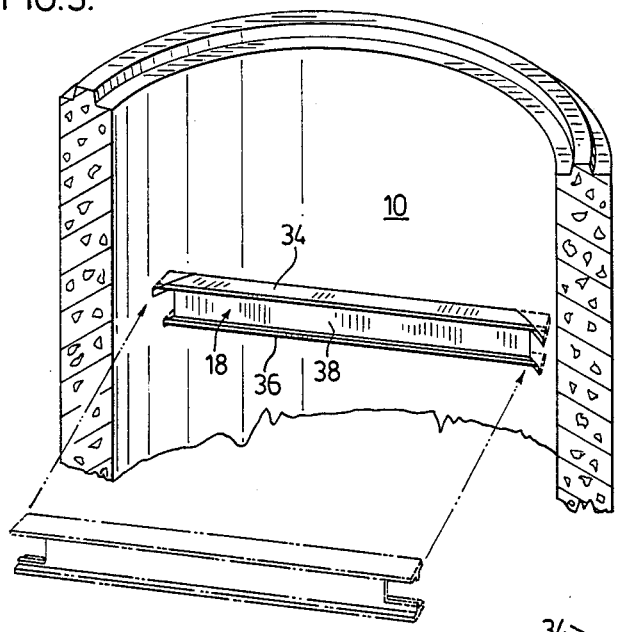
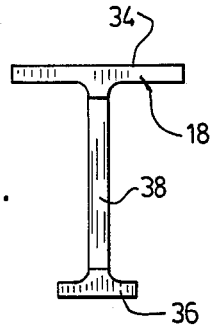
FIG.4.
FIG.5.
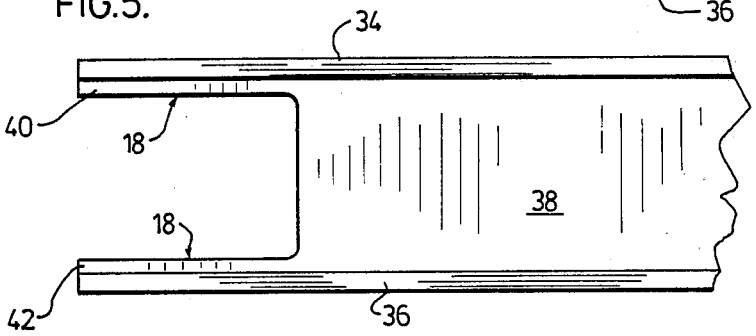

FIG.9.
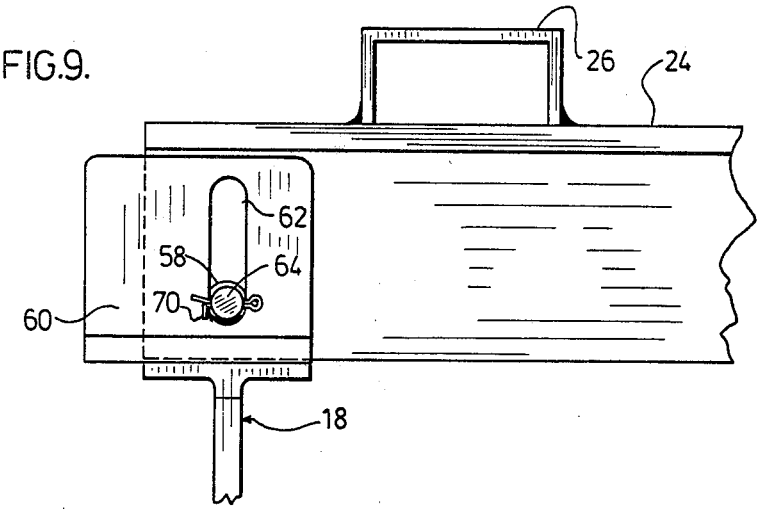
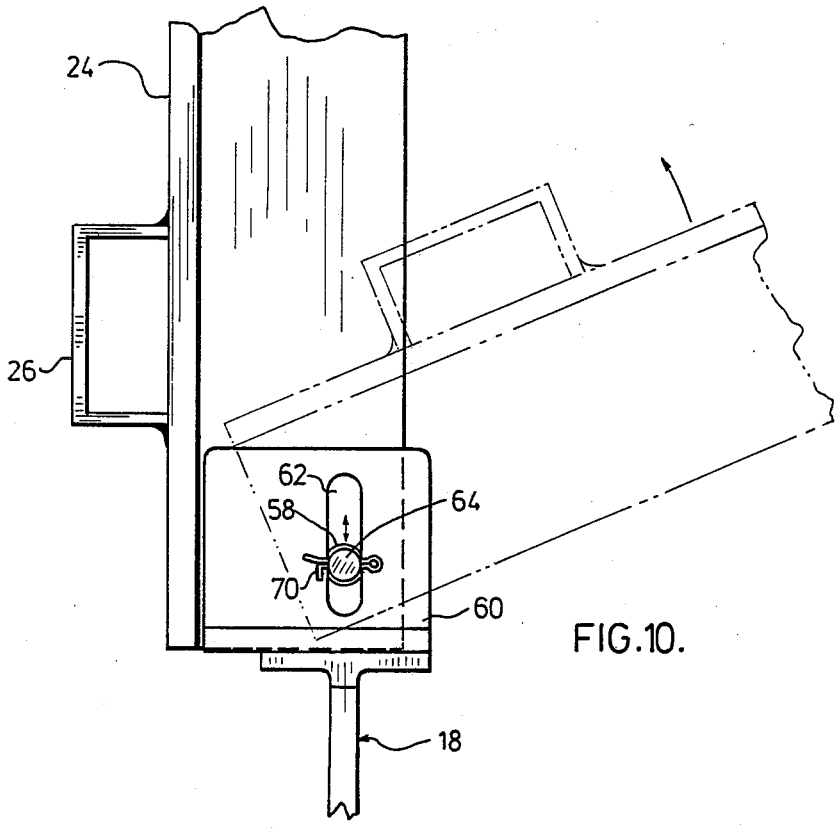
FIG.10.

SAFETY LANDING

BACKGROUND OF THE INVENTION

1. Field of the Invention

This invention relates to an improved safety landing which is used to divide a vertical shaft or manhole at predetermined positions.

2. Description of the Prior Art

Safety landings, safety platforms and safety gratings are common terms used to describe a supporting subfloor which is fixed at various elevations to divide a vertical shaft or manhole into separate areas.

Safety landings are used for various purposes. They will limit the vertical distance that a falling object is allowed to fall before it is stopped by the safety grating. Thus, if a workman drops a tool, the tool will be stopped by the safety landing to make its retrieval easier. More importantly, if a workman slips while climbing up or down the vertical shaft, his fall will be interrupted by the safety landing which in many cases, saves the life of the workman or reduces the possible injury which results from the fall.

Safety landings are also used to interrupt long vertical climbs or descents by workmen by providing a platform transition area for the workman before he continues his climb or descent.

Also, by limiting the vertical climbing or descent distance to a safe height, the workman must stop his ascent or descent at each safety landing to open or close the landing. This forces the workmen to rest at the safety landing and reduces significantly, the fatigue created by long ascents and descents. By doing so, a significant reduction in accidents has occurred due to fatigue of the workman.

The safety landing also provides a dry working floor area above liquid or waste filled shafts or manholes as well as providing a working platform to enable the workman to perform various tasks and jobs in the shaft or manhole such as pump maintenance and reading gauges.

In designing a safety landing, its operation must be standardized so that it is easy for the workman to operate in a similar fashion to the conventional grate. It must have a positive means for controlling access to various levels in the manhole and also, it must be easy enough for the operator to operate but not so easy to allow a workman to tamper with its safety features to circumvent these features. The landings must have sufficient strength to carry different types of loads, particularly for heavy machinery which may be placed in the landing when the landing is used as a working platform. The landing must also be strong enough to withstand continuous use over a long period of time without failing.

The prior art devices usually comprise a pair of panels, each panel comprising a plurality of platform rungs usually made of aluminum. The pair of panels are placed side by side and the opposite ends of the panels are pivotally attached to a support. The support is driven into the manhole wall when the concrete is still green.

Each panel may be pivoted independently to the vertical position and affixed to the wall of the manhole by a snaphook and chain. In its installation, these devices must be aligned exactly with respect to the elevation of the device and also with respect to its orientation.

Also, the manner of installation is both cumbersome and time consuming. The use of a hook and chain (as found in the prior art devices) to maintain the panel in the upright position and the use of a J-bolt to lock the panel in the horizontal position requires extra labour in installation and their use cannot be ensured by the workman. With these devices, it is possible for workmen to circumvent these means which may result in an unfortunate accident. The support has also required a great amount of concrete displacement for its installation and the restrictive tolerances demand great care and dimensional control during installation.

SUMMARY OF THE INVENTION

Accordingly, it is an object of the present invention to at least partially overcome these disadvantages by providing a novel safety landing which requires reduced operator skill for installation.

It is a further object of the present invention to provide a novel safety landing which allows greater dimensional tolerances than do the prior art devices.

It is a still further object of the present invention to provide a novel safety landing which eliminates or reduces the need of a layout or measuring support beam location.

A further object of the invention is to provide a novel safety landing which during installation, minimizes the amount of green concrete that must be disturbed during installation, thus producing a stronger joint with the manhole and minimizing leakage through the manhole casing.

A still further object of the present invention is to provide a novel safety landing which has a reduced number of components which require assembly during installation.

It is an object of the present invention to provide a novel safety landing for use with manholes or similar vertical shafts, which may be constructed and installed efficiently and which performs its functions in a simplified manner yet provides the safety requirements for the operator.

To this end, in one of its aspects, the invention provides a safety platform for use in a vertical shaft defined by a wall, said platform comprising:

(a) a pair of support beams, each support beam having two ends which are mounted in the inner surface of said wall;

(b) at least one panel which extends across the shaft and which bridges said support beams;

(c) a moveable securing means adapted to releasably secure one end of the at least one panel to one of said support beams; and (d) a pivotting means adapted to pivotally secure the other end of the at least one panel to the opposite support beam.

In another of its aspects, the invention further provides a safety platform for use in a vertical shaft defined by a wall, said platform comprising:

(a) a pair of support beams, each support beam having two ends which are mounted in the inner surface of said wall, each support beam being an I-beam having a flat, top surface, a lower surface, and a web therebetween, wherein said web is recessed at each respective end thereby providing an upper and a lower prong at each end of said beam, (b) two panels which extend across the shaft and which bridges said support beams, each panel comprising a pair of carrier bars with an outturned flange on the bottom of each carrier bar, and at least one slat-like element extending between said carrier bars, (c) a moveable securing means adapted to releasably secure one end of the at least one panel to one of said support beams, said moveable securing means comprising a wedge clip which is slidably engageable with the top of said I-beam and which is adapted to secure the flange of said carrier bar to the top of said I-beam, said wedgeclip being adapted to overlap said flange and said I-beam and adapted to wedge thereagainst thereby providing a releasable lock for the panel to the support beam, (d) a pivotting means adapted to pivotally secure the other end of the at least one panel to the opposite support beam, said pivotting means comprising a hole in one end portion of each carrier bar, a pair of locking lugs with slots affixed to the top surface of the support beams, said lugs displaced from each other such that each lug is adjacent the inside surface of each carrier bar, a hinge pin extending through the locking lugs and through the slots in the end portion of each carrier bar, and a cotter pin to prevent the hinge pin from moving in either lateral direction.

BRIEF DESCRIPTION OF THE DRAWINGS

Further objects and advantages of the invention will appear from the following description taken together with the accompanying drawings in which:

FIG. 1 is a top plan view of a safety platform embedded in the wall of a vertical shaft (shown in section);

FIG. 2 is a side elevational view of the safety platform with one panel in the raised position;

FIG. 3 is a perspective view showing one support beam embedded in the wall of the vertical shaft;

FIG. 4 is an end view of a support beam of the safety platform of the present invention;

FIG. 5 is a side view of an end portion of a support beam of the safety platform;

FIG. 9 is a side elevational view showing the end of the panel secured in the closed position on the support beam;

FIG. 10 is a side elevational view showing the end of the panel and the support beam as the panel is being raised;

DESCRIPTION OF THE PREFERRED EMBODIMENT

Figure 6:
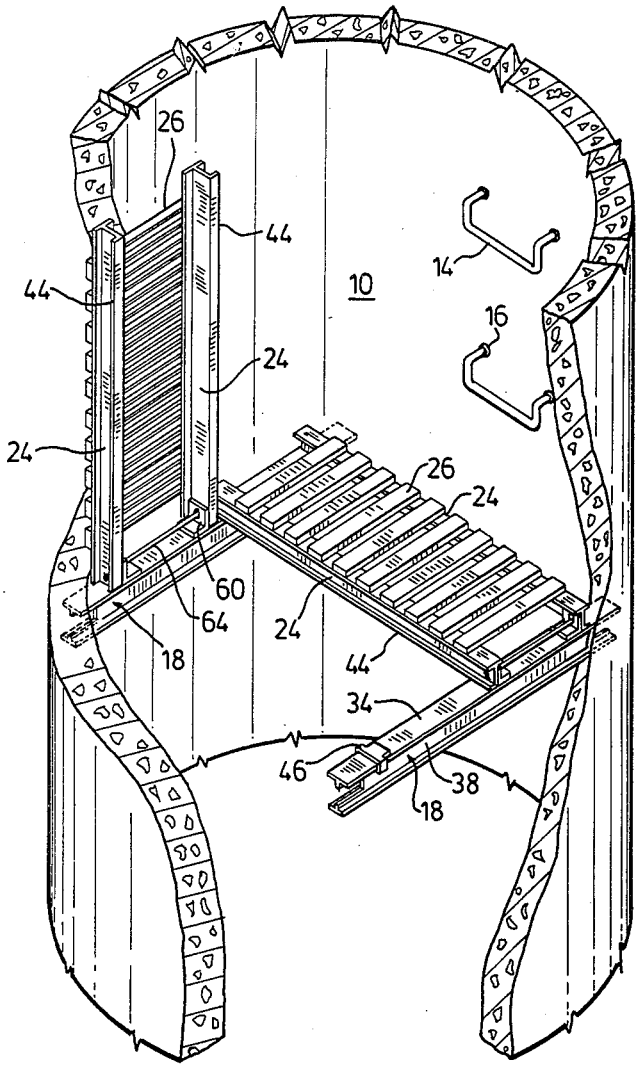
FIG. 6 is a perspective view of the safety platform showing one panel in the open position and one panel in the closed position.

Referring to the drawings, and in particular, to FIG. 1, there is shown a top plan view of a safety platform in a vertical shaft. A vertical shaft or manhole usually comprises a cylindrical casing 10 which is inserted into the ground in a vertical orientation. In most cases, the vertical shaft is constructed of concrete although other suitable materials may be used. These vertical shafts or manholes are well-known in the prior art and may be constructed on the site or elsewhere for later transportation to the site. Safety platforms, generally indicated as 12, are disposed at predetermined heights along the height of the casing 10 and safety steps 14 are usually mounted into the walls of the casing 10 between the safety platforms 12 to allow workmen to climb up and down the manhole. These steps 14 are usually embedded into the inner wall of the casing 10 and secured by means of plugs 16 or other suitable devices.

The safety platform 12 of the present invention comprises a pair of support beams 18 whose ends 20 are mounted in the inner wall of the casing 10. The platform 12 includes at least one panel 22 which is shown in the figures as a pair of panels although the number may be varied. Two panels are preferred because this provides a place for the workman to stand or place his equipment while he adjusts the other panel. Each panel 22 preferably comprises a pair of carrier bars 24 and a plurality of slat-like elements 26 bridging the carrier bars.

The structure of the safety platform 12 having a pair of panels 22 allows each of the panels to be pivotted to the open position, independently of the other panel. Thus, as shown in FIG. 2, the panel 28 is shown in the open or vertical position while panel 30 remains in the closed or horizontal position. Means 32 are provided which allow each of the panels 28, 30 to be independently pivotted to the vertical position and the structure and mode of operation of means 32 will be explained in detail hereinafter. It is preferable that each of the panels 28, 30 independently pivot to the vertical position at opposite ends. In other words, means 32 which allows each panel to pivot to the open position is affixed to the opposite end of each panel so that the pivotting of each panel occurs on the opposite support beam.

As shown in FIGS. 3 to 5, the support beams 18 (only one is shown) is preferably, an I-beam having a top surface 34, a lower surface 36 and a web 38 therebetween. The top surface 34 is generally flat and for the ease of construction, the bottom surface 36 is also flat although not required. The web 38 is recessed at each end (FIG. 5 where one end is shown) thereby providing a pair of prongs 40, 42 at each end.

Figure 7:
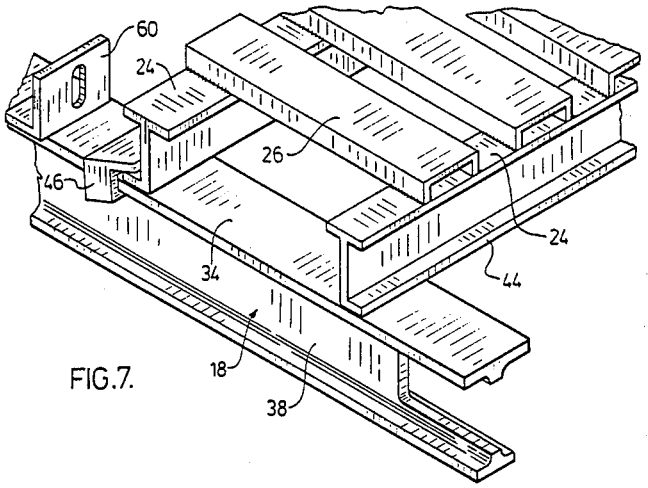
FIG. 7 is a perspective view of a wedge clip locking the panel (partially shown) to a support beam.
Figure 8:
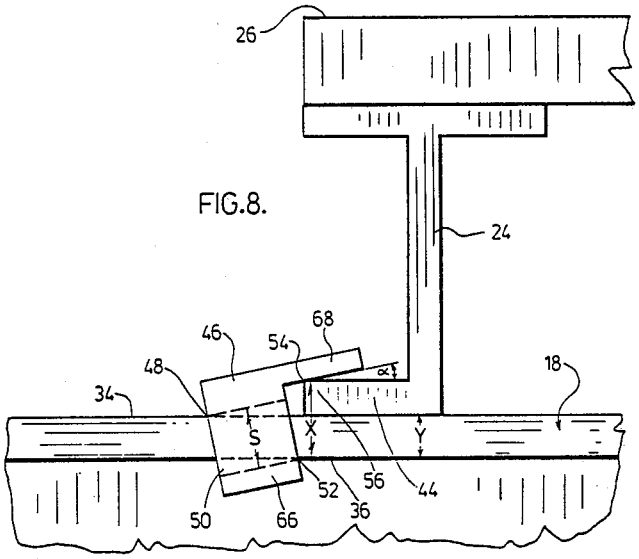
FIG. 8 is an enlarged side elevational view of the wedge clip of FIG. 7.

The panel 22 as best shown in FIGS. 6 to 8 comprises a pair of carrier bars 24 and a plurality of slat-like elements 26 extending between the carrier bars 24. Each carrier bar 24 has an outturned flange 44 on the bottom thereof.

When the panel 22 is in the closed position, it may be secured to the support beams to prevent inadvertent opening of the panel and to allow the workmen to safely work or stand on the panel. One end of the panel 22 is pivotally secured to a support beam 18 (as will be explained hereinafter in detail), and the other end is releasably secured to the other support beam 18 in the following manner.

Referring to FIGS. 7 and 8, a wedge clip 46 is provided on the support beam 18 and is slid thereon prior to the insertion of the support beam 18 into the manhole casing 10. The clip 46 is slid along the beam 18 so that it is located on the beam 18 on the side of the carrier bar 24 which carries flange 44. The panel 22 is then lowered to the support beam 18 and rests thereon. The wedge clip 46 is then tapped or pushed towards the carrier bar 24 and it is wedged onto the flange 44 of the carrier bar 24 and the support beam 18 as shown in FIGS. 7 and 8. When the panel 22 is to be raised to the open position, the clip 46 is forced in the opposite direction thereby allowing the panel 22 to be raised to the open position.

The wedge clip 46 comprises a body portion 66 and a lip portion 68. In the preferred embodiment, as shown in FIG. 8, the clip 46 is of an inverted L-configuration. The body portion 66 of the clip 46 has a slot 50 cut therein and the slot 50 enables the clip to be slid along the support beam 18. The height (S) of the slot 50 is greater than the height (Y) of the support beam 18 but is less than the combined height (X) of the support beam 18 and the flange 44 of the carrier bar 24.

The theory of the operation of the wedge clip 46 will now be explained. In the locked position, the upper heel 48 of the slot 50 of the clip 46 engages the top surface 34 of the support beam 18. Lower toe 52 of the slot 50 of the clip 46 engages the lower surface 36 of the support beam 18 and lip 68 engages the outer upper corner 56 of the flange 44 at point 54. Referring to FIG. 8, the height S of the slot 50 must be greater than the height of the support beam 18 and as long as the distance between the inner corner of lip 68 at point 54 and the point of contact between the toe 52 and the beam 18 (hereinafter X) is greater than the height S, the wedge clip 46 can be wedged onto the carrier bar 24 and the support beam 18 and it maintains this arrangement. The height X should only exceed the height S by a marginal amount so that the angle $\alpha$(as shown in FIG. 8) is acute. When $\alpha$ is smaller, the wedge clip 46 can be secured as shown. As $\alpha$ increases, the holding power is proportionately decreased.

By this construction, a mechanical advantage is achieved which allows the wedge clip 46 to operate efficiently. As long as S is less than X, then a binding will occur as shown in FIG. 8. The distance from the point of contact 54 on the lip 68 with the flange 44 and the end of the lip 54 compared to distance from the end of the lip 68 to the flange 44 relates to the mechanical advantage of the clip.

At the opposite end of the panel 22, there is provided a mechanism which allows the panel 22 to pivot from the horizontal position to the vertical position and which retains the panel 22 in the vertical position.

Figure 11:
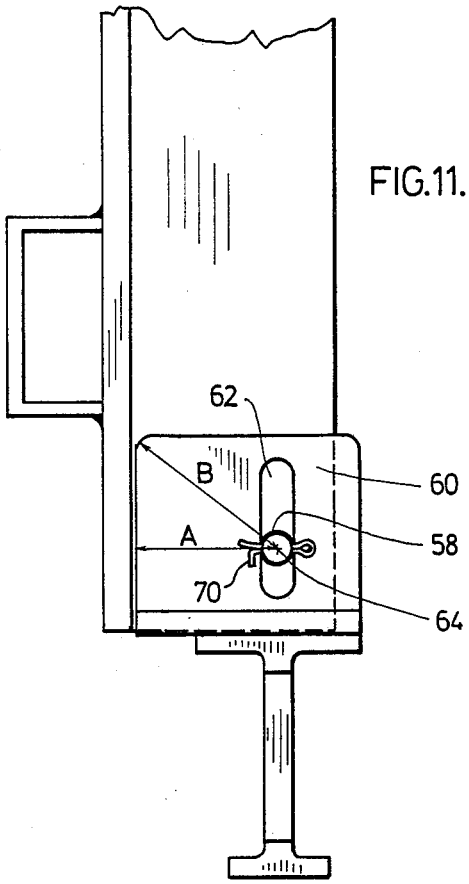
FIG. 11 is a side elevational view showing the end of the panel in the open or raised position.

Referring to FIGS. 9 to 11, the pivotting means comprises a hole 58 cut in one end of each of the carrier bars 24 of the panel 22, and a pair of locking lugs 60 mounted on the top surface 34 of the support beam 18. Each locking lug 60 has a corresponding slot 62 cut therein. The lugs 60 are displaced so that each lug is adjacent the inside surface of each carrier bar 24. A hinge pin 64 extends through the slots 62 of the lugs 60, and through the holes 58 in the carrier bars 24. Any suitable means 70 is provided to restrict the lateral movement of the hinge pin 64. This suitable means may include, for example, a shear pin or a cotter pin.

In order to move the panel 22 from a horizontal position (FIG. 9) to a vertical position (FIG. 11), the panel 22 is first lifted upwards as shown in FIG. 10. This causes the hinge pin 64 to rise vertically in the slot 62 and the panel 22 then rotates about the locking lugs 60. When the panel 22 is in vertical alignment, the weight and alignment of the panel 22 with the slot 62, causes the panel 22 and the hinge pin 64 to drop into the locked position. The locking is caused by the reaction of the locking lugs 60 and the hinge pin 64 in the final dropped position in the slot 62 as shown in FIG. 11.

To close the panel 22 (or to move it to the horizontal position), the panel 22 is lifted vertically which causes the hinge pin 64 to ride up the vertical slot 62. The panel 22 is then swung towards the horizontal position and the panel 22 is then lowered into the horizontal position and secured by the wedge clip 46.

The theory of operation of the mechanism which allows the panel to pivot will now be explained. The movement of the panel is based on the distances measured between the centre axis of the hinge pin perpendicularly to the outer edge of the lug (hereinafter referred to as "A") and the distance from the centre axis of the hinge pin to the upper outside corner of the lug (hereinafter referred to as "B") as shown in FIG. 11.

When the panel is in either the horizontal or the vertical position, B is greater than A. When the panel is raised, A approaches B in value and when B equals A, then the panel can be rotated from either the horizontal to the vertical or from the vertical to the horizontal position. Thus, even with the panel in the vertical position, it cannot be either accidentally or deliberately, moved to the horizontal position without first raising the panel in order that B equals A. When the panel is in the vertical position, it will not move or fall to the horizontal position even if it is struck or pulled as in this case, B is greater than A. If a large force is applied to the panel, at most, the shear or cotter pin may break. If the fulcrum is shifted and becomes equal to A, then the panel will move but this will only occur when the panel is first lifted.

The manner of installation of the safety platform of the present invention provides distinct advantages when compared to the prior art devices. Vertical shafts or manholes are usually constructed of concrete. When the support beams of the prior art constructions are inserted into the concrete walls of the casing, it is absolutely necessary to align these support beams for both elevation and parallelism. Once the workman makes these calculations, the support beams are then driven into the walls displacing a large amount of concrete.

With the structure of the present device, this procedure has been simplified and the time and expertise required to insert these devices has been significantly reduced. With the present devices, the pitch of the support beams is self-setting and is not as critical as with the prior art devices. Since the panels sit on the top surface of the support beams rather than fit inside the web as in the prior art devices, the tolerances required for installation have been reduced.

A further advantage of the present invention is that the particular shape and the construction of the support beams has eliminated the angle irons used as support beams in the prior art and thus, the installation of the support beams does not require a separate step for the preparation of the cavity. With the angle irons of the prior art, a significant amount of concrete is displaced when they are inserted into the casing whereas with the I-beams of the present invention, only a minimum of concrete is displaced.

The advantages of the present invention reside in two main areas. The construction requires less skill and expertise to install thereby decreasing the costs involved. The second area is that the safety factor has been increased. The latter is particularly important and involves the following considerations. The upright panel is securely held in place without requiring the workman to insert chains, locks etc. of the prior art devices. The inventor's have found that many workmen try and succeed to circumvent the safety features and in particular, the locking mechanisms of the prior art devices which hold the upright panel in the vertical position. This is impossible with the present invention.

The panel is automatically locked in the vertical position and this locking mechanism cannot be circumvented, dropped or misplaced as with prior art devices.

The wedge clip is also tamper proof and is permanently available. It is easy to install and to use yet when installed, provides a secure device to lock the panel in the horizontal position. The entire device may be made inexpensively which is quite significant when one realizes that safety platforms occur about every 15 feet in a manhole.

Although the disclosure describes and illustrates a preferred embodiment of the invention, it is to be understood the invention is not so restrictive to this particular embodiment.

What I claim is:

1. A safety platform for use in a vertical shaft defined by a wall, said platform comprising:

(a) a pair of support beams, each support beam having two ends which are mounted in the inner surface of said wall;

(b) at least one panel which extends across the shaft and which bridges said support beams;

(c) a moveable securing means adapted to releasably secure one end of the at least one panel to one of said support beams; and (d) a pivotting means adapted to pivotally secure the other end of the at least one panel to the opposite support beam.

2. A safety platform as claimed in claim 1 wherein each support beam is an I-beam having a top surface, a lower surface and a web therebetween.

3. A safety platform as claimed in claim 2 wherein said top surface is flat.

4. A safety platform as claimed in claim 2 wherein the web is recessed at each respective end thereby providing an upper and a lower prong at each end of said beam.

5. A safety platform as claimed in claim 2 wherein said panel comprises a pair of carrier bars with an outturned flange on the bottom of each carrier bar, and at least one slat-like element extending between said carrier bars.

6. A safety platform as claimed in claim 5 wherein said moveable securing means is a wedge clip which is slidably engageable with the top of said I-beam and which is adapted to secure the flange of said carrier bar to the top of said I-beam.

7. A safety platform as claimed in claim 6 wherein said wedge clip is adapted to overlap said flange and said I-beam and is adapted to wedge thereagainst thereby providing a releasable lock for the panel to the support beam.

8. A safety platform as claimed in claim 6 wherein said pivotting means comprising a hole in one end portion of each carrier bar, a pair of locking lugs with slots affixed to the top surface of the support beams, said lugs displaced from each other such that each lug is contiguous with the inside surface of each carrier bar, a hinge pin extending through the locking lugs and through the holes in the end portions of each carrier bar.

9. A safety platform as claimed in claim 8 wherein said pivotting means further includes a stop means to prevent the hinge pin from moving in either lateral direction.

10. A safety platform as claimed in claim 9 wherein said stop means is a shear pin.

11. A safety platform as claimed in claim 9 wherein said stop means is a cotter pin.

12. A safety platform for use in a vertical shaft defined by a wall, said platform comprising:

(a) a pair of support beams, each support beam having two ends which are mounted in the inner surface of said wall, each support beam being an I-beam having a flat, top surface, a lower surface, and a web therebetween, wherein said web is recessed at each respective end thereby providing an upper and a lower prong at each end of said beam, (b) two panels which extend across the shaft and which bridges said support beams, each panel comprising a pair of carrier bars with an outturned flange on the bottom of each carrier bar, and at least one slat-like element extending between said carrier bars, (c) a moveable securing means adapted to releasably secure one end of the at least one panel to one of said support beams, said moveable securing means comprising a wedge clip which is slidably engageable with the top of said I-beam and which is adapted to secure the flange of said carrier bar to the top of said I-beam, said wedge clip being adapted to overlap said flange and said I-beam and adapted to wedge thereagainst thereby providing a releasable lock for the panel to the support beam, (d) a pivotting means adapted to pivotally secure the other end of the at least one panel to the opposite support beam, said pivotting means comprising a hole in one end portion of each carrier bar, a pair of locking lugs with slots affixed to the top surface of the support beams, said lugs displaced from each other such that each lug is adjacent the inside surface of each carrier bar, a hinge pin extending through the slots in locking lugs and through the holes in the end portion of each carrier bar, and a cotter pin to prevent the hinge pin from moving in either lateral direction.

13. A safety platform as claimed in claim 12 wherein said wedge clip comprises a body portion and a lip portion, said body portion having a slot therein of a greater height than the combined height of said flange and said I-beam, said wedge clip being slidable on said I-beam which extends through said slot in said body portion of said wedge clip.

* * * * *